US007897017B2

(12) United States Patent
Schmitt

(10) Patent No.: US 7,897,017 B2
(45) Date of Patent: Mar. 1, 2011

(54) MICROSTRUCTURED MONOFILAMENT AND TWINED FILAMENTS

(75) Inventor: Matthias Schmitt, Munich (DE)

(73) Assignee: Voith Patent GmbH, Heidenheim (DE)

( * ) Notice: Subject to any disclaimer, the term of this patent is extended or adjusted under 35 U.S.C. 154(b) by 462 days.

(21) Appl. No.: 11/625,010

(22) Filed: Jan. 19, 2007

(65) Prior Publication Data

US 2007/0197334 A1 Aug. 23, 2007

(30) Foreign Application Priority Data

Jan. 28, 2006 (DE) ..... 10 2006 004 106

(51) Int. Cl.
*D21F 1/10* (2006.01)
*D21F 7/08* (2006.01)
*D21F 7/12* (2006.01)

(52) U.S. Cl. ..... 162/348; 162/358.2; 162/900; 162/902; 162/903; 428/358; 428/400

(58) Field of Classification Search ..... 162/116, 162/348, 358.1, 358.2, 361, 900–904, 306; 139/383 A, 425 A; 428/358, 397–400
See application file for complete search history.

(56) References Cited

U.S. PATENT DOCUMENTS 2,288,512 A * 6/1942 Buchanan ..... 139/425 A
3,158,984 A * 12/1964 Butler ..... 139/425 A
4,105,495 A * 8/1978 Pai ..... 162/348
4,350,731 A * 9/1982 Siracusano ..... 442/270
4,633,596 A * 1/1987 Josef ..... 34/116
4,799,998 A * 1/1989 Dutt ..... 162/348
4,829,681 A * 5/1989 Josef ..... 34/123
4,943,476 A * 7/1990 Sokaris ..... 442/187
5,097,872 A * 3/1992 Laine et al. ..... 139/426 R
5,361,808 A * 11/1994 Bowen, Jr ..... 139/383 A
5,366,798 A * 11/1994 Ostermayer ..... 442/207
5,449,548 A * 9/1995 Bowen, Jr. ..... 442/195
5,591,525 A * 1/1997 Keller ..... 428/374
5,651,394 A * 7/1997 Marchand ..... 139/383 A
5,985,450 A * 11/1999 Keller ..... 428/401
5,998,310 A * 12/1999 Bowen, Jr. ..... 442/196
6,171,446 B1 * 1/2001 Diaz-Kotti ..... 162/358.2
6,773,786 B1 * 8/2004 Kuckart ..... 428/141
6,790,796 B2 * 9/2004 Smith et al. ..... 442/189
6,875,314 B2 * 4/2005 Korfer et al. ..... 162/358.2
7,196,043 B2 * 3/2007 Valpey et al. ..... 510/204
2003/0068948 A1 4/2003 Smith et al.
2003/0148687 A1 8/2003 Korfer et al.

FOREIGN PATENT DOCUMENTS

EP 1333120 8/2003
WO 01/21884 3/2001
WO 03/031711 4/2003

* cited by examiner

*Primary Examiner*—Eric Hug
(74) *Attorney, Agent, or Firm*—Greenblum & Bernstein, P.L.C.

(57) ABSTRACT

An apparatus for the production of a fibrous web, in particular a paper web or paperboard web, having a belt formed from individual threads which are connected together, in particular woven together, whereby the surface of the threads is constructed to be structured in order to improve the paper quality and the production flow.

27 Claims, 2 Drawing Sheets

MICROSTRUCTURED MONOFILAMENT AND TWINED FILAMENTS

CROSS-REFERENCE TO RELATED APPLICATIONS

The present application claims priority under 35 U.S.C. §119 of German Patent Application No. 10 2006 004 106.2, filed Jan. 28, 2006, the disclosure of which is expressly incorporated by reference herein in its entirety.

BACKGROUND OF THE INVENTION

1. Field of the Invention

This invention relates to an apparatus for the production of a fibrous web, in particular a paper web or paperboard web, having a belt formed from individual threads which are connected together, in particular woven together. In particular, the apparatus includes a belt formed from individual threads which can be a microstructured monofilament or a twined filament.

2. Background and Related Information

For belts such as transport belts and dewatering belts fabrics are commonly employed. It is known that the stability of fabrics for paper production is of decisive importance for their performance on the paper machine. However, the distortion of fabrics due to poor transverse stability or creep lead, on the paper machine and in the production flow, causes considerable problems and complaints. In addition, loose wefts in the fabric can result in local dewatering differences and hence in visible markings on the paper web. For this reason the stability of the fabrics is continually checked in the quality assurance department by measuring their bending rigidity and displacement resistance.

SUMMARY OF THE INVENTION

One aspect of the present invention is to improve, with regard to paper quality and the production flow, a machine of the apparatus initially referred to. Therefore, the present invention provides that the surface of the threads is constructed to be a structured surface. Through the structured construction of the surface of the threads of the belt, the friction between the individual threads is increased and hence the stability of the belt improved. Through the improved stability of the belt it is possible in turn to reduce the problems in the production flow and to improve the paper quality.

The present invention provides a belt for the production of a fibrous web, including individual threads which are connected together, wherein a surface of the threads is constructed to be structured. In some embodiments, the individual threads can be woven together.

In some embodiments, the surface of the threads has in particular a microstructure or nanostructure. Thus, the friction between the threads can thus be increased without essentially influencing the other properties of the belt.

In some embodiments, monofilaments can be provided as threads for the belt. However, it is also possible, depending on the case of application, to use twine, meaning monofilaments which are twisted together.

In some embodiments, the provision of flutes has proven to be particularly well suited for structuring the thread surface. In some embodiments, the flutes can extend parallel or transverse to the longitudinal axis of the threads. In some embodiments, the flutes can also form an angle with the longitudinal axis of the threads.

In some embodiments, the flutes can be crossed in the thread surface. This results in a particularly large increase in friction and hence in a great improvement in the stability properties of the belt.

In some embodiments, the flutes are arranged in a rhombic pattern in the surface of the threads. This can also produce a particularly large increase in friction.

In some embodiments, the flutes are arranged in arrow shape in the surface of the threads. This also results in good friction values.

In some embodiments, it has proven to be advantageous for the surface of the threads to be equipped with between 1 and 10 flutes per micrometer. This results in good friction values and an accordingly good stability of the belts.

In some embodiments, another possibility is for the surface of the threads to be constructed like a shark's skin. Shark skin is known to have particularly good flow properties, which can likewise be advantageous in paper machine belts.

In some embodiments, another suitable possibility for increasing the friction between the threads is to construct the surface with individual studs. Individual studs can provide a microroughness which increases the friction likewise in an advantageous manner.

In some embodiments, it is possible for the threads to be constructed with a lotus-effect surface. Thus, in addition to increasing the friction it is also possible to reduce the inclination toward soiling.

In some embodiments, the friction of the surface can be increased by surface structuring of the threads so as to twist the threads about their own longitudinal axis or with each other. In this case too the otherwise smooth surface of the threads or twines acquire a structure, by which the friction between the threads or twines is increased.

In some embodiments, it can be an advantage in addition to vary the shape, distribution and/or density of the structuring of the thread surface in any particular manner over an individual thread or over the belt as a whole. For example, the structuring on the side of the belt facing the fibrous web can be finer than on the side facing away from it. Account can thus be selectively taken of special needs.

In some embodiments, it is possible to establish a gradient of the structure density over the length and/or width of the belt. In this case too it is thus possible to take account of special cases of application.

In some embodiments, threads structured according to the invention can be used as warp threads, tie threads and/or weft threads. The result in each case is a suitable increase of friction in the belt.

In some embodiments, the threads structured according to the present invention can be thermofixed. Consequently the threads contact and interlock with each other via the surface structure. This leads to reduced slip between the threads and hence to the desired increase in friction, resulting in the desired increase in stability of the belt.

In some embodiments, the belt can be advantageously used in a forming mesh. Furthermore, in some embodiments, a belt structured according to the present invention can also be advantageously used in a dryer fabric or as the basic fabric of a press felt. Thus, the present invention contemplates a method of using the belt of the present invention in a forming mesh, dryer fabric or as the basic fabric of a press felt The present invention also provides a method of making a belt for the production of a fibrous web, including forming a structured surface on a plurality of individual threads, and connecting the individual threads together to form a belt.

In some embodiments, the method of making a belt can also include forming flutes, a shark skin-like surface, studs, or a lotus-effect surface on the surface of the threads.

BRIEF DESCRIPTION OF THE DRAWINGS

The present invention is further described in the detailed description which follows, in reference to the noted plurality of drawings by way of non-limiting examples of preferred embodiments of the present invention, in which like numerals represent like elements throughout the several views of the drawings, and wherein.

DETAILED DESCRIPTION OF THE PREFERRED INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
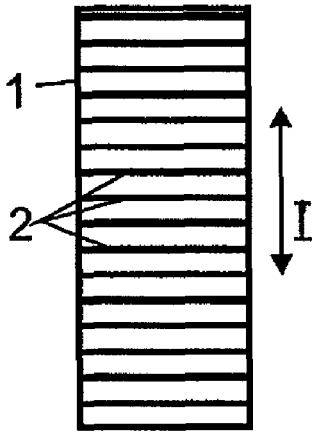
FIGS. 1 to 6 show a plan view of a section of a thread with a surface structure according to various embodiments of the present invention.

Referring to the drawings wherein like numerals represent like elements, FIG. 1 shows a section of a thread 1 with a surface structured according to the invention, whereby the structuring is formed by flutes 2 extending transverse to the longitudinal axis I of the thread 1. The flutes 2 are arranged parallel to each other and are the same distance from each other.

Figure 2:
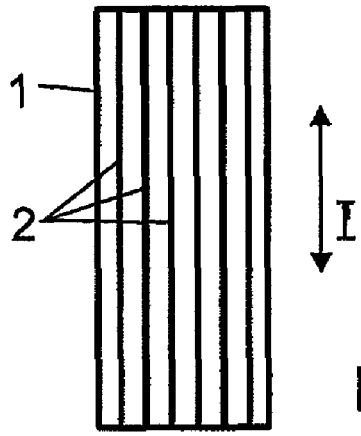

On the variant shown in FIG. 2, the flutes 2 are arranged parallel to the longitudinal direction I of the thread 1. As in FIG. 1, the flutes 1 are the same distance from each other and are arranged parallel to each other.

Figure 3:
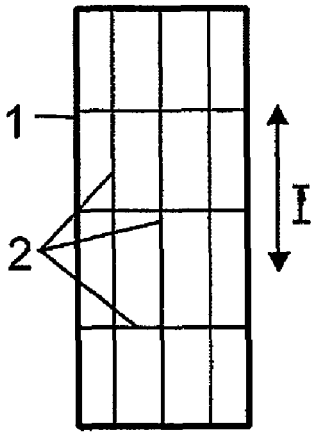

On the variant shown in FIG. 3, provision is made for flutes 2 extending both transverse to and parallel to the longitudinal direction I of the thread 1. As can be seen in FIG. 3, the result is a crossed structuring of the surface of the thread 1. Here, too, the transverse flutes on the one hand and the longitudinal flutes on the other hand extend respectively parallel to each other and are respectively the same distance from each other. However, it is understood that in some embodiments, the distance between the transverse flutes can be greater than that between the longitudinal flutes, and vice versa, such that rectangular islands are thus formed between the flutes.

Figure 4:
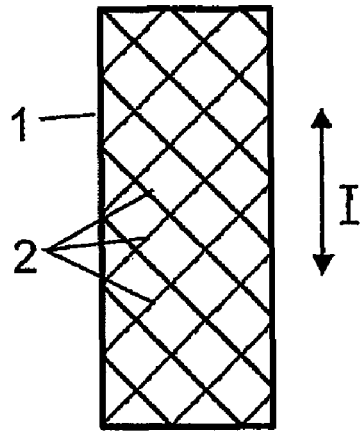

On the exemplary embodiment of FIG. 4, the surface of the thread 1 is structured likewise in the shape of a cross. In this case, however, the crossed flutes 2 extend at an angle, i.e., oblique to the longitudinal direction I of the thread 1. The flutes 2 extend in the one direction and in the other direction at an incline to the longitudinal direction I and respectively parallel to each other. Further, the parallel flutes 2 can be respectively the same distance from other. Moreover, as illustrated in the exemplary embodiment of FIG. 4, the distances in both cases can be the same such that a rhombic pattern with uniform rhombi is formed.

Figure 5:
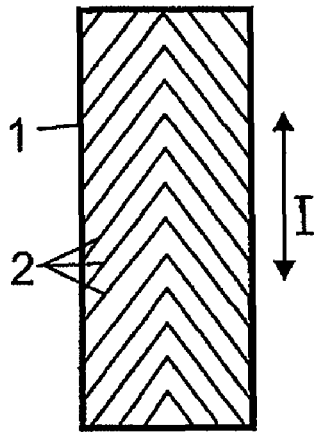

Similarly, on the embodiment of FIG. 5 the flutes 2 extend at an angle to the longitudinal direction I of the thread 1. However, the flutes 2 are not arranged in cross shape but in a type of arrow pattern. This means that on the one half of the thread 1 the flutes 2 are inclined in the one direction and on the other half of the thread 1 the flutes 2 are inclined in the opposite direction to the longitudinal direction I of the thread such that they extend toward each other.

Figure 6:
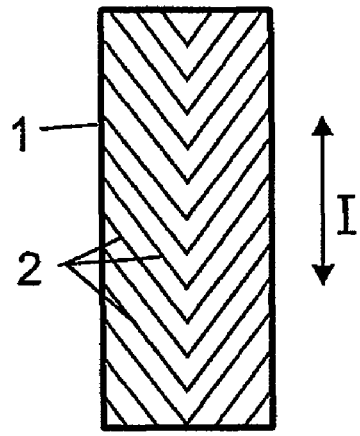

The exemplary embodiment of FIG. 6 is largely the same as the variant in FIG. 5, except that the arrow direction is reversed.

Figure 7:
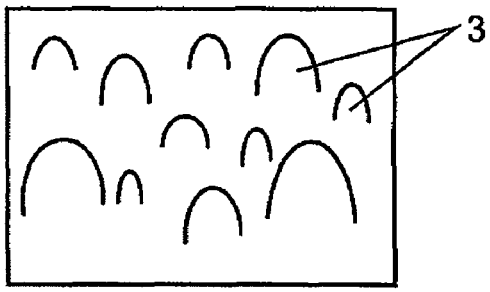
FIGS. 7 to 10 show details from surfaces of threads structured according to various embodiments of the present invention.

FIG. 7 shows an exemplary embodiment on which studs 3 and not flutes are provided in the surface of the thread 1. In this case, the studs are distributed essentially uniformly over the surface. The studs can be identical in size or different in size to each other, as shown. However, it is particularly advantageous for the resulting surface of the thread 1 to at least have a microroughness.

Figure 8:
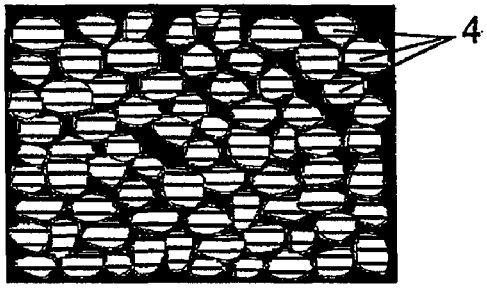
Figure 9:
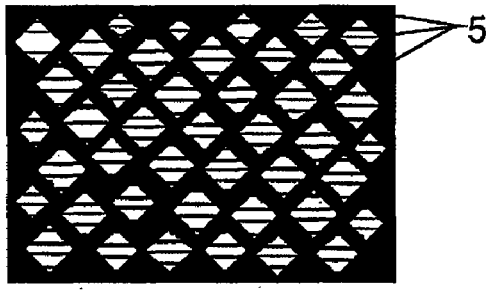
Figure 10:
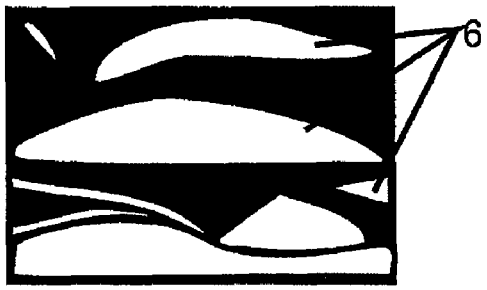

The exemplary embodiments of FIGS. 8 to 10 show surface structures which in each case simulate the skin of a shark. The embodiment illustrated in FIG. 8 corresponds largely to the skin on the tip of a shark's nose and is comprised of a type of densely packed pins 4, the embodiment presented in FIG. 9 corresponds to the skin on a shark's fin with scales 5, and the embodiment presented in FIG. 10 corresponds to the skin on a shark's back with disks 6. All three embodiments offer good flow properties.

In the case of the flute structures presented, provision is made for preferably 1 to 10 flutes per micrometer. This results in a good increase of friction for the threads 1. It is also possible for threads 1 with a different number of flutes to be distributed over the belt. Similarly, it is possible to provide a different density of flutes on the bottom side of the belt than on the top side. In particular it is also possible to establish a gradient of the structure density over the length or width of the belt. In all cases the threads can be used respectively as warp threads, tie threads and/or weft threads. A belt with threads of this type can be used in a forming mesh, a dryer fabric and/or as the basic fabric of a press felt. In this case the threads are preferably thermofixed.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

Further, when an amount, concentration, or other value or parameter, is given as a list of upper preferable values and lower preferable values, this is to be understood as specifically disclosing all ranges formed from any pair of an upper preferred value and a lower preferred value, regardless whether ranges are separately disclosed.

LIST OF REFERENCE NUMERALS

1 Thread
2 Flute
3 Stud
4 Pin
5 Scale
6 Disk
I Longitudinal direction of thread 1

What is claimed:

1. A belt for the production of a fibrous web, comprising:
individual threads which are connected together;
a surface of the threads being structured; and
the threads contacting and interlocking with each other via the structured surface,
wherein the structured surface comprises a lotus-effect surface.

2. The belt according to claim 1, wherein the individual threads are woven together.

3. The belt according to claim 1, wherein the structured surface of the threads has a microstructure.

4. The belt according to claim 1, wherein the structured surface of the threads has a nanostructure.

5. The belt according to claim 1, wherein the threads comprise monofilaments.

6. The belt according to claim 1, wherein the threads comprise twines.

7. The belt according to claim 1, wherein the threads are twisted about their own longitudinal axis or with each other.

8. The belt according to claim 1, wherein the shape, distribution and/or density of a structuring of the structured surface is varied over an individual thread or over the belt as a whole.

9. The belt according to claim 1, wherein the threads are warp threads, tie threads and/or weft threads.

10. The belt according to claim 1, wherein the belt is used in a forming mesh.

11. The belt according to claim 1, wherein the threads are thermofixed.

12. A method of using the belt according to claim 1 in a dryer fabric.

13. A method of using the belt according to claim 1 as the basic fabric of a press felt.

14. The belt according to claim 1, wherein the threads have flutes extending transverse to a longitudinal axis of the threads.

15. The belt according to claim 1, wherein the threads have studs distributed essentially uniformally over a surface of the threads.

16. A belt for the production of a fibrous web, comprising:
individual threads which are connected together,
wherein a surface of the threads is constructed to be structured,
wherein the threads have flutes in their surface, and
wherein the flutes are arranged in cross shape.

17. The belt according to claim 16, wherein 1 to 10 flutes are provided per micrometer of the surface of the threads.

18. A belt for the production of a fibrous web, comprising:
individual threads which are connected together,
wherein a surface of the threads is constructed to be structured,
wherein the threads have flutes in their surface,
wherein the flutes form an angle with the longitudinal axis of the threads, and
wherein the flutes are arranged in a rhombic pattern.

19. A belt for the production of a fibrous web, comprising:
individual threads which are connected together,
wherein a surface of the threads is constructed to be structured,
wherein the threads have flutes in their surface,
wherein the flutes form an angle with the longitudinal axis of the threads, and
wherein the flutes form an arrow pattern.

20. A belt for the production of a fibrous web, comprising:
individual threads which are connected together,
wherein a surface of the threads is constructed to be structured, and
wherein the surface of the threads is constructed like a shark's skin.

21. A belt for the production of a fibrous web, comprising:
individual threads which are connected together,
wherein a surface of the threads is constructed to be structured, and
wherein the threads have a lotus-effect surface.

22. A belt for the production of a fibrous web, comprising:
individual threads which are connected together;
a surface of the threads being structured,
wherein one of:
the threads have flutes extending transverse to a longitudinal axis of the threads;
the threads have studs distributed essentially uniformally over a surface of the threads;
the threads have densely packed pins on a surface of the threads which resemble shark nose skin;
the threads have scales on a surface of the threads which resemble shark fin skin; and
the threads have disks on a surface of the threads which resemble shark back skin,
wherein the shape, distribution and/or density of a structuring of the structured surface is varied over an individual thread or over the belt as a whole, and
wherein the structuring on the side of the belt facing the fibrous web is finer than on the side facing away from it.

23. A belt for the production of a fibrous web, comprising:
individual threads which are connected together;
a surface of the threads being structured,
wherein one of:
the threads have flutes extending transverse to a longitudinal axis of the threads;
the threads have studs distributed essentially uniformally over a surface of the threads;
the threads have densely packed pins on a surface of the threads which resemble shark nose skin;
the threads have scales on a surface of the threads which resemble shark fin skin; and
the threads have disks on a surface of the threads which resemble shark back skin,
wherein the shape, distribution and/or density of a structuring of the structured surface is varied over an individual thread or over the belt as a whole, and
wherein a gradient of the structure density is established over the length and/or width of the belt.

24. A method of making a belt for the production of a fibrous web, comprising:
forming a structured surface on a plurality of individual threads, and
connecting the individual threads together to form a belt such that the threads contact and interlock with each other via the structured surface,
wherein the structured surface comprises a shark skin-like surface.

25. A method of making a belt for the production of a fibrous web, comprising:

forming a structured surface on a plurality of individual threads, and connecting the individual threads together to form a belt, wherein forming a structured surface on a plurality of individual threads comprises forming a shark skin-like surface on the threads.

26. A method of making a belt for the production of a fibrous web, comprising:

forming a structured surface on a plurality of individual threads, and connecting the individual threads together to form a belt, wherein forming a structured surface on a plurality of individual threads comprises forming a lotus-effect surface on the threads.

27. A belt for the production of a fibrous web, comprising:

individual threads which are connected together;

a surface of the threads being structured, wherein one of:

the threads have flutes extending transverse to a longitudinal axis of the threads;

the threads have studs distributed essentially uniformally over a surface of the threads;

the threads have densely packed pins on a surface of the threads which resemble shark nose skin;

the threads have scales on a surface of the threads which resemble shark fin skin; and the threads have disks on a surface of the threads which resemble shark back skin, and wherein one of:

the threads have densely packed pins on a surface of the threads which resemble shark nose skin;

the threads have scales on a surface of the threads which resemble shark fin skin; and the threads have disks on a surface of the threads which resemble shark back skin.

* * * * *